US006226824B1

(12) United States Patent
Hopson et al.

(10) Patent No.: US 6,226,824 B1
(45) Date of Patent: May 8, 2001

(54) KNIFE WITH MULTIPLE ROLLER WHEELS

(76) Inventors: Eric J. Hopson; Tammy Hopson, both of 1828 Kimset Pkwy., Cape Corral, FL (US) 33909

( * ) Notice: Subject to any disclaimer, the term of this patent is extended or adjusted under 35 U.S.C. 154(b) by 0 days.

(21) Appl. No.: 09/205,746

(22) Filed: Dec. 4, 1998

(51) Int. Cl.[7] ..... B26B 11/00
(52) U.S. Cl. ..... 7/158; 29/235; 81/488
(58) Field of Search ..... 7/105, 158; 81/488; 29/235

(56) References Cited

U.S. PATENT DOCUMENTS

| | | | |
|---|---|---|---|
| Re. 32,501 | | 9/1987 | Okada . |
| 4,062,116 | * | 12/1977 | Arnott . |
| 4,197,605 | * | 4/1980 | King . |
| 4,797,963 | * | 1/1989 | Gulino . |
| 4,809,437 | * | 3/1989 | Saliaris . |
| 4,910,821 | * | 3/1990 | Kieferle ..... 7/158 |
| 4,974,320 | * | 12/1990 | Pelletier . |
| 5,072,471 | * | 12/1991 | Isler . |
| 5,203,852 | * | 4/1993 | Downing et al. . |
| 5,355,588 | * | 10/1994 | Brandenberg, Jr. et al. . |
| 5,555,562 | * | 9/1996 | Scheminger . |
| 5,711,077 | * | 1/1998 | Schulz et al. . |
| 5,725,727 | * | 3/1998 | Tutewohl . |

* cited by examiner

*Primary Examiner*—James G. Smith
(74) *Attorney, Agent, or Firm*—Joseph N. Breaux

(57) ABSTRACT

A knife with multiple roller wheels comprising an elongate hollow housing adapted to be held and operated by one hand. The housing has a first end with a slot and an opposite second end. A knife blade is provided. A structure is for retractably extending the knife blade from the slot in the first end of the housing to trim a window screen. Two roller wheels are also provided. A facility is for rotatably supporting in spaced apart relationships the two roller wheels. An assembly pivotally connects the supporting facility to one side of the housing adjacent to the second end. A stop member supports the supporting facility in a stationary position, so that one of the roller wheels will extend beyond the second end of the housing to install the window screen in a window screen frame.

8 Claims, 3 Drawing Sheets

KNIFE WITH MULTIPLE ROLLER WHEELS

TECHNICAL FIELD

The present invention relates to hand held rotary tools and more particularly to a knife with multiple roller wheels. The knife with multiple roller wheels is a window screen repair knife and roller assembly comprising a retractable knife blade having two nylon roller wheels mounted on a flip over arm at the rear of a knife housing. One of the roller wheels is a rounded one eighth inch squared nylon wheel and the other is a rounded one sixteenth inch squared nylon wheel. Each roller wheel can be flipped out and supported in place with a protruding stop tab that extends outwardly from one side of the knife housing.

BACKGROUND ART

Numerous hand held rotary tools have been provided in prior art. For example, U.S. Pat. No. 4,062,116 to Arnott; U.S. Pat. No. 4,197,605 to King; U.S. Pat. No. Re. 32,501 to Okada; U.S. Pat. No. 4,797,963 to Gulino; U.S. Pat. No. 4,809,437 to Saliaris; U.S. Pat. No. 4,974,320 to Pelletier; U.S. Pat. No. 5,072,471 to Isler; U.S. Pat. No. 5,203,852 to Downing et al.; U.S. Pat. No. 5,355,588 to Brandenburg, Jr. et al.; U.S. Pat. No. 5,555,625 to Scheminger; U.S. Pat. No. 5,711,077 to Schulz et al.; and U.S. Pat. No. 5,725,727 to Tutewohl all are illustrative of such prior art. While these units may be suitable for the particular purpose to which they address, they would not be as suitable for the purposes of the present invention as heretofore described.

The Arnott U.S. Pat. No. 4,062,116 discloses a fabric cutting tool. A fabric cutting tool comprising an elongated shank curved and bifurcated at one end and a handle on the other, the bifurcated end having a spring loaded rotary cutting blade rollingly mounted between the bifurcation, a protective shield for the blade, a pair of guide wheels for assisting in the cutting, and a foot plate providing a cutting surface for the fabric.

The King U.S. Pat. No. 4,197,605 discloses a glazing tool. An improved glazing tool including a manually operable cutting device, of a scissors-type variety, having a pair of arms mediately secured to one another by a pin for permitting pivotal movement therebetween, on one side of the pin the arms having face-to-face complementary cutting edges thereon and on the other side of the pin a pair of handles permitting manual operation thereof, one of the arms being longer than the other arm, the forward most portion of the longer arm having a hub with a small roller freely mounted thereon, and the opposite end of the longer arm extending rearwardly beyond the other arm forming a handle and terminating in a flat blade.

The Okada U.S. Pat. No. Re. 32,501 discloses a rotary cutter. A rotary cutter which includes an elongated handle having an aperture extending through its one end, a shaft extending through the aperture so as to be supported by the handle, a disc blade rotatably mounted on the shaft and lying in a plane perpendicular to the longitudinal axis of the shaft, and a member engageable with the shaft, with a bearing projection formed on the handle coaxially with the aperture.

The Gulino U.S. Pat. No. 4,797,963 discloses a carpet finishing tool. A carpet finishing tool having a handle supporting a longitudinal shaft, the shaft being angularly cut proximate to its end to permit the mounting of a biased rotatable disk having a truncated conical outer surface and rounded edges, the edges contacting the carpet for securing the carpet when the carpet is secured in a tacked mode, the truncated conical outer surface contacting the carpet and securing the carpet when the carpet is secured in an adhesive mode.

The Saliaris U.S. Pat. No. 4,809,437 discloses a manually manipulated cutting device. A manual cutting device for severing generally planar food stuffs, such as pizza, which is characterized by an elongate handle provided with a removably mounted, circular cutting blade rotatably mounted to the handle. A removably mounted pivot pin is provided which is releasably locked through aligned openings in the handle and the circular cutting blade to permit easy assembly and disassembly of the handle and cutting blade for cleaning purposes.

The Pelletier U.S. Pat. No. 4,974,320 discloses a rotatable utility knife. An improved utility knife including a handle with a razor cutting blade end and a toothed cutting wheel end. An alternate embodiment includes a necked handle with a toothed cutting wheel affixed to a retractable arm which thereby allows the toothed cutting wheel to be retracted within the handle. A measuring device retention means is located near the toothed cutting wheel such that drywall can be measured and scored at the same time.

The Isler U.S. Pat. No. 5,072,471 discloses a knife with two wheels. A tool especially designed for a workman in a particular industry has an elongate handle with a retractable sliding knife blade at a first end. At a second end a pair of rotatable wheels are mounted. When constructed for screen installation, one of the wheels has a convex edge for forming the screen in the groove of the screen frame and the other wheel has a concave edge for firmly holding a locking spline and forcing it into the groove to lock the screen in place. Where constructed for the paperboard box fabricator, one of the wheels has piercing points for laying out a pattern (a pounce wheel) and the other wheel has a convex edge for pressing a folding groove into the paperboard. The tool makes it possible for the worker to perform three different tasks normally performed in sequence with a single, hand held tool to speed up his work, the knife being for trimming off screen or paperboard as required.

The Downing et al. U.S. Pat. No. 5,203,852 discloses a carpet tucking device. A carpet tucking device utilizing a rotatable member having a core and a removable cover for the core. The cover possesses an outer surface capable of contacting the carpet and further includes a first flange portion and second endless portion. A handle is connected to the rotatable member by a connecting element which forms an obtuse angle between the handle and the rotatable member.

The Brandenburg, Jr. et al. U.S. Pat. No. 5,355,588 discloses a rotary cutting blade assembly for a hand-held cutter. A rotary cutter having a handle, a cylindrical head formed on one end of the handle and having a planar surface on each side of the head, an actuating member pivotally mounted in the head, a circular blade mounted on the actuating member and having a pinking or wave shaped cutting edge offset from the blade to form a hub, the blade being secured to one side of the actuating member with the hub located in a parallel relation to one of the planar surfaces, and a finger guard formed as an integral part of the handle and head.

The Scheminger U.S. Pat. No. 5,555,625 discloses a rotary cutter. A rotary cutter employs a disc blade removably mounted on a cylindrical bearing surface portion carried to upstand from adjacent one end of a handle and a swing arm movable between a retaining position in which it overlies the disc blade and a release position in which it is removed from overlying relation with the disc blade to permit removal thereof, wherein a first latch portion disposed adjacent the bearing surface portion and a second latch portion carried by the swing arm engaged to removably retain the swing arm in its retaining position.

The Schulz et al. U.S. Pat. No. 5,711,077 discloses a double blade actuator for a hand-held cutter blade assembly. A rotary cutter including a handle, a cylindrical head formed on one end of the handle and having a planar surface on each side, the handle and head having an interval cavity, an actuating member mounted in the cavity in the handle and head, a blade support formed on the actuating member for movement between a storage position and one of two operating positions with respect to the head, a spring mounted on the actuating member for biasing the actuating member to a storage position and a latch assembly formed in the actuating member for electively locking the actuating member in one of the two operating positions.

The Tutewohl U.S. Pat. No. 5,725,727 discloses a combination laminating tool. A three-in-one combination laminating tool configured in form of an elongate handle having a first end and an opposite second end, a freely-rotatable roller supported at the first end of the handle, and a relatively narrow blade-like laminate edge presser supported at the opposite second end of the handle. The first end of the handle comprises a generally U-shaped yoke having a pair of spaced-apart arms for rotatably supporting the roller therebetween. The tool allows carpenters, cabinetmakers, and other users the convenience of one hand operation in applying pressure to the entire surface of a plastic laminate or wood veneer. Specifically, an evenly distributed pressure is applied via the relatively large roller to the large easily accessible surface areas of the laminate, and via the narrow blade-like laminate edge presser to those typically inaccessible surface areas of the laminate, such as corners, edges or butt joints. Preferably the tool further includes a relatively broad blade-like veneer presser, releasably mountable to the second end of the handle, for applying pressure to delicate and thin wood veneers.

GENERAL SUMMARY DISCUSSION OF INVENTION

The knife with multiple roller wheels consists of a standard type retractable knife blade (with internal blade storage), and a flip over arm holding replaceable roller wheels. Provided roller wheels include a rounded one eighth inch squared nylon wheel, and a one sixteenth inch squared nylon wheel. Each roller wheel has a center mounted roller bearing and is attached with a washer and a screw to one end of the flip over arm. The flip over arm attaches toward the rear of a knife housing with the use of a washer and a screw. When needed, the arm is flipped over so that the required roller wheel faces the back of the housing for use. The flip over arm is supported in place by a protruding stop tab at the back of the housing.

A primary object of the present invention is to provide a knife with multiple roller wheels that will overcome the shortcomings of the prior art devices.

Another object is to provide a knife with multiple roller wheels that is a combination tool for use by screen repairmen and installers.

An additional object is to provide a knife with multiple roller wheels that is a standard type retractable knife blade utility knife with two nylon roller wheels attached to each end of a flip over arm mounted at the rear of the knife housing, allowing a person installing a window screen to both install and trim the screen with the use of only one tool.

A further object is to provide a knife with multiple roller wheels that is simple and easy to use.

A still further object is to provide a knife with multiple roller wheels that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Similar reference characters denote corresponding features consistently throughout the attached drawings.

EXEMPLARY MODE FOR CARRYING OUT THE INVENTION

Figure 1:
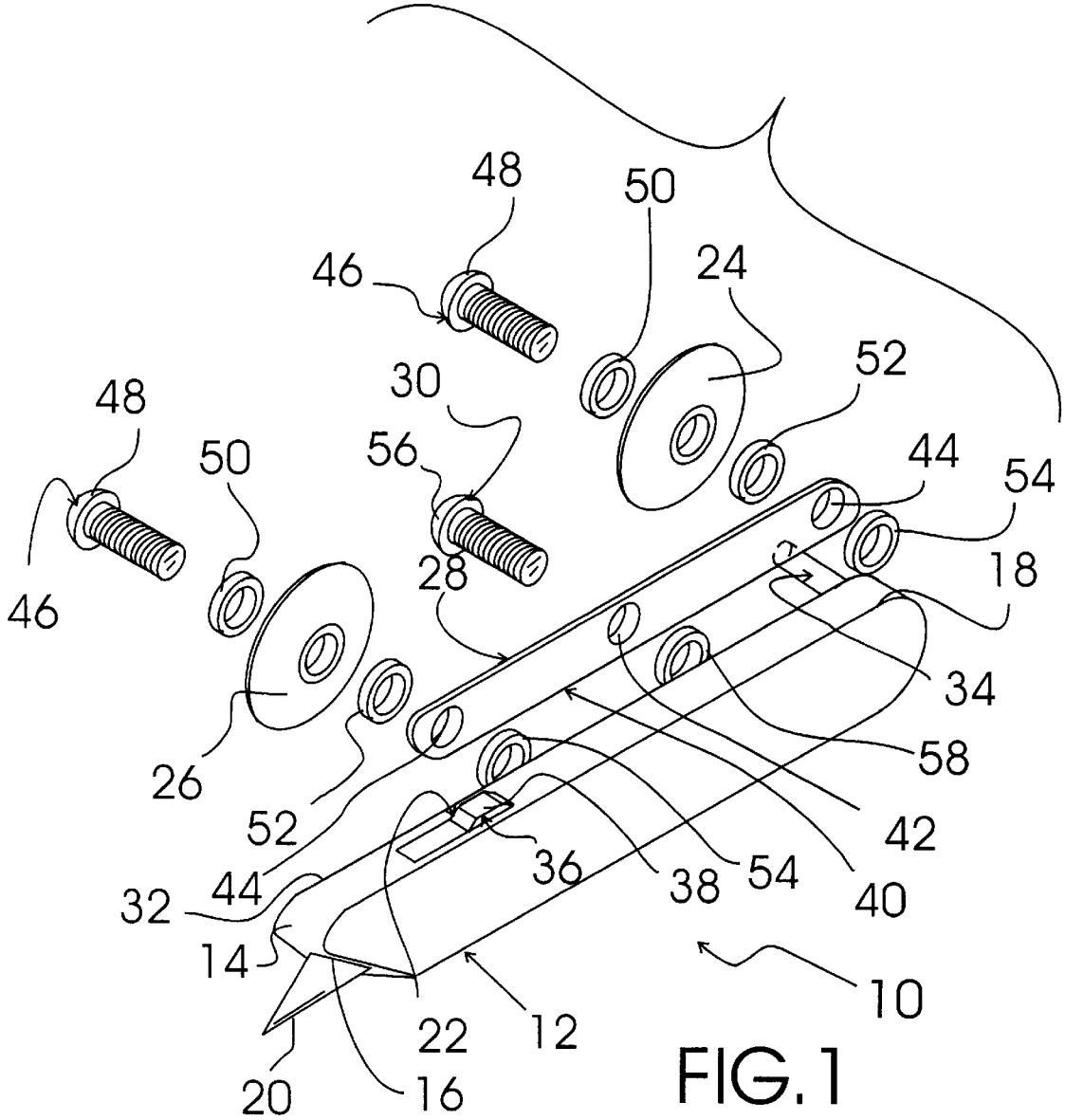
FIG. 1 is an exploded perspective view of the present invention.
Figure 2:
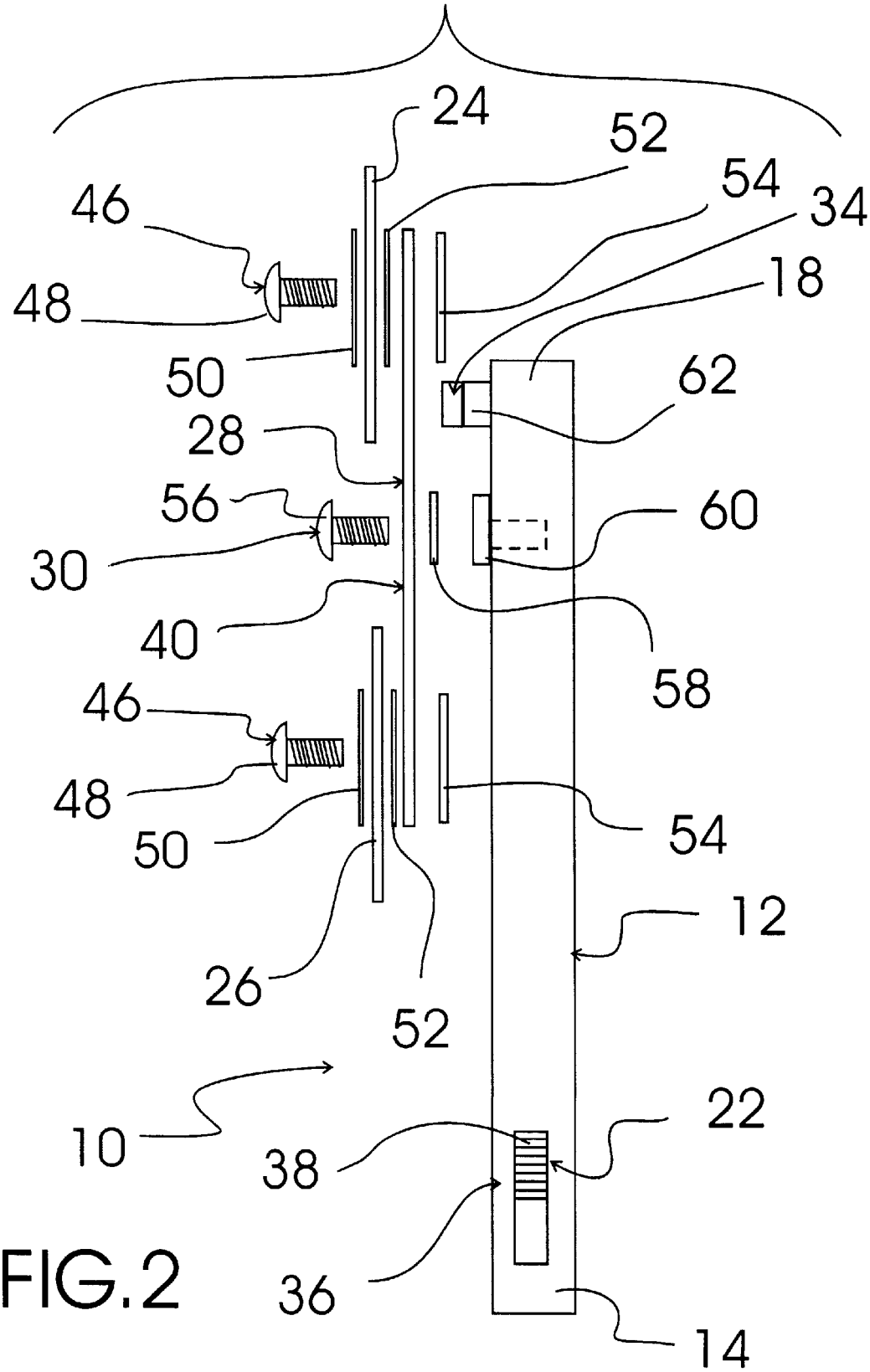
FIG. 2 is an exploded top plan view taken in the direction of arrow 2 in FIG. 1.
Figure 3:
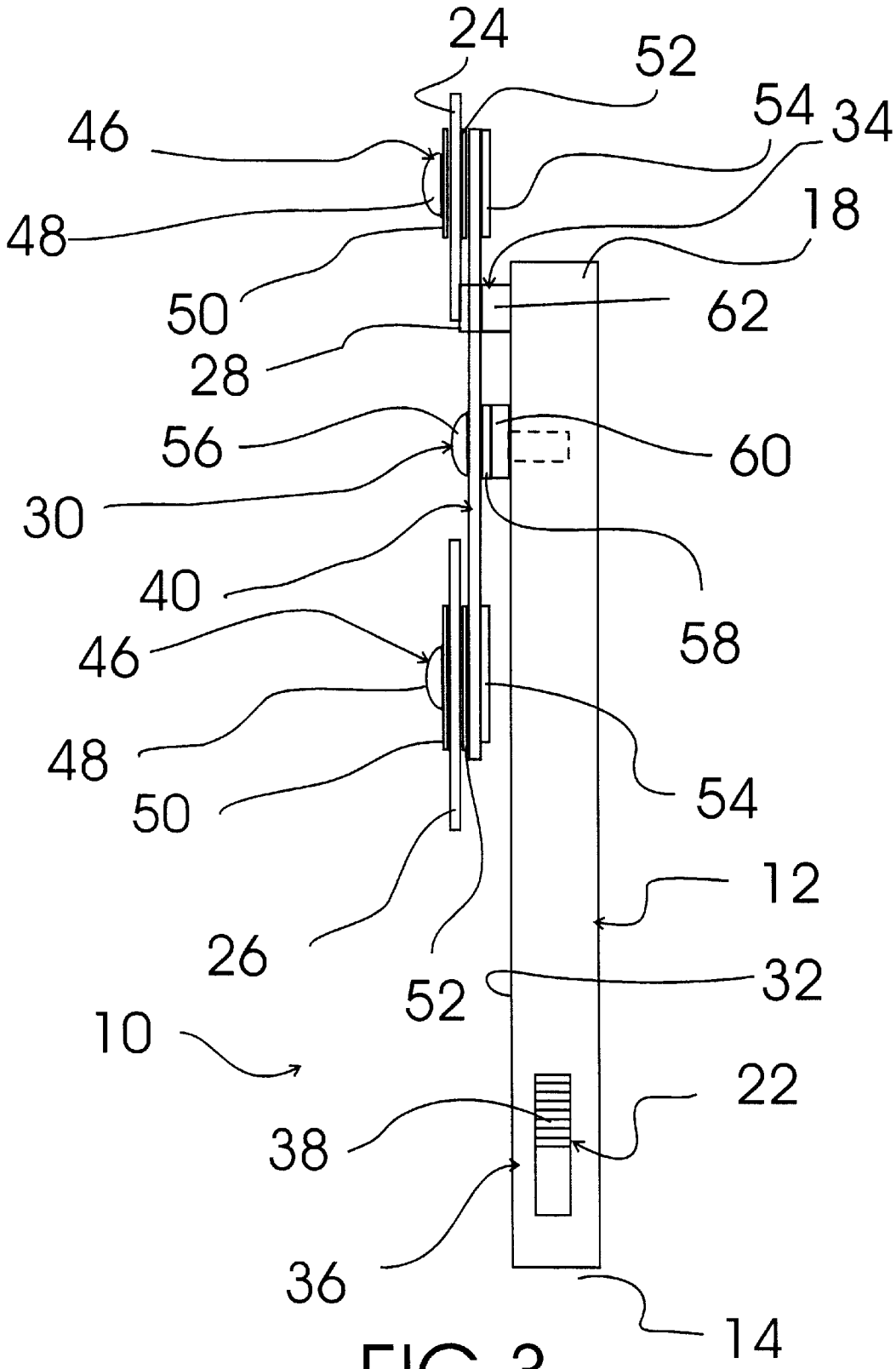
FIG. 3 is an assembled top plan view similar to FIG. 2.

Turning now descriptively to the drawings, in which similar reference characters denote similar elements throughout the several views, FIGS. 1 through 3 illustrate the various features of the present invention being a knife 10 with multiple roller wheels comprising an elongate hollow housing 12 adapted to be held and operated by one hand. Housing 12 has a first end 14 with a slot 16 and an opposite second end 18. A knife blade 20 is provided. A structure 22 is for retractably extending knife blade 20 from slot 16 in first end 14 of housing 12 to trim a window screen. Two roller wheels 24, 26 are also provided. A facility 28 is for rotatably supporting in spaced apart relationships the two roller wheels 24 and 26. An assembly 30 is for pivotally connecting supporting facility 28 to one side 32 of housing 12 adjacent to second end 18. A stop member 34 is for supporting facility 28 in a stationary position, so that one of the roller wheels 24, 26 will extend beyond second end 18 of housing 12 to install the window screen in a window screen frame.

Retractably extending structure 22 includes a carrier 36 for knife blade 20 reciprocally mounted within housing 12 at first end 14 for movement toward and away from slot 16. The carrier 36 has a finger grip 38 extending upwardly through housing 12 for movement of carrier 36. First roller wheel 24 is a rounded one eighth of an inch squared nylon wheel. Second roller wheel 26 is a rounded one sixteenth of an inch squared nylon wheel.

Supporting facility 28 includes a flip over arm 40 having a central aperture 42 and two end apertures 44 therethrough. A pair of mounting assemblies 46 rotatively attach each roller wheel 24, 26 at one end aperture 44 of flip over arm 40. Each mounting assembly 46 contains a mounting screw 48, a mounting washer 50, a roller bearing 52 and a mounting nut 54 for rotatively attaching each roller wheel 24, 26 through one end aperture 44 of flip over arm 40.

Pivotally connecting assembly 30 consists of a pivot screw 56, a pivot washer 58 and a built-in pivot nut 60 on one side 32 of housing 12 for pivotally attaching flip over arm 40 at central aperture 42 to one side 32 of housing 12. Stop member 34 is a tab 62 protruding from one side 32 of housing 12 adjacent to second end 18 to engage with and keep flip over arm 40 in the stationary position.

It can be seen from the preceding description that in use, a person who is installing or repairing a window screen will flip the flip over arm 40 to the required roller wheel 24, 26, support it in place with the tab 62, use the selected roller wheel 24, 26 on the knife housing 12 and enjoy the benefit of having an all-in-one utility knife and screen bead roller. This allows the person to install the screen retaining bead and trim excess screen with one tool, requiring the use of just one hand. Use of the knife 10 with multiple roller wheels will provide an extremely versatile and easy to use tool that will enable the person to perform screen installation and repair on windows or porches in a far faster and more efficient manner. The knife 10 with multiple roller wheels will provide an immeasurable benefit to anyone working with window screens, whether being used at the commercial level, or just by a home handyman.

It is noted that the embodiment of the knife with multiple roller wheels described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A knife with multiple roller wheels comprising:

an elongate hollow housing adapted to be held and operated by one hand, said housing having a first end with a slot and an opposite second end;

a knife blade;

means for retractably extending said knife blade from said slot in said first end of said housing to trim a window screen;

two roller wheels;

means for rotatably supporting in spaced apart relationships said two roller wheels;

means for pivotally connecting said supporting means to one side of said housing adjacent to said second end; and means for stopping said supporting means in a stationary position, so that one of said roller wheels will extend beyond said second end of said housing to install the window screen in a window screen frame.

2. The knife with multiple roller wheels as recited in claim 1, wherein:

said retractably extending means includes a carrier for said knife blade reciprocally mounted within said housing at said first end for movement toward and away from said slot, said carrier having a finger grip extending upwardly through said housing for movement of said carrier.

3. The knife with multiple roller wheels as recited in claim 1, wherein:

said first roller wheel is a rounded one eighth of an inch squared nylon wheel.

4. The knife with multiple roller wheels as recited in claim 1, wherein:

said second roller wheel is a rounded one sixteenth of an inch squared nylon wheel.

5. The knife with multiple roller wheels as recited in claim 1, wherein:

said supporting means includes a flip over arm having a central aperture and two end apertures therethrough, and a pair of mounting assemblies to rotatively attach each said roller wheel at said one end aperture of said flip over arm.

6. The knife with multiple roller wheels as recited in claim 5, wherein:

each said mounting assembly includes a mounting screw, a mounting washer, a roller bearing and a mounting nut for rotatively attaching each said roller wheel through said one end aperture of said flip over arm.

7. The knife with multiple roller wheels as recited in claim 5, wherein:

said pivotally connecting means includes a pivot screw, a pivot washer and a built-in pivot nut on said one side of said housing for pivotally attaching said flip over arm at said central aperture to said one side of said housing.

8. The knife with multiple roller wheels as recited in claim 5, wherein:

said stopping means includes a locking tab protruding from said one side of said housing adjacent to said second end to engage with and keep said flip over arm in the stationary position.

* * * * *